US009376925B2

(12) United States Patent
Delapierre et al.

(10) Patent No.: US 9,376,925 B2
(45) Date of Patent: Jun. 28, 2016

(54) TURBINE ENGINE FAN

(75) Inventors: Michael Delapierre, Moissy Cramayel (FR); Patrick Jean-Louis Reghezza, Moissy Cramayel (FR)

(73) Assignee: SNECMA, Paris (FR)

( * ) Notice: Subject to any disclaimer, the term of this patent is extended or adjusted under 35 U.S.C. 154(b) by 919 days.

(21) Appl. No.: 13/576,071

(22) PCT Filed: Jan. 21, 2011

(86) PCT No.: PCT/FR2011/050116

§ 371 (c)(1), (2), (4) Date: Jul. 30, 2012

(87) PCT Pub. No.: WO2011/095722

PCT Pub. Date: Aug. 11, 2011

(65) Prior Publication Data

US 2012/0294721 A1 Nov. 22, 2012

(30) Foreign Application Priority Data

Feb. 4, 2010 (FR) ..... 10 00456

(51) Int. Cl.
*F01D 5/30* (2006.01)
*F04D 29/32* (2006.01)

(52) U.S. Cl.
CPC ..... *F01D 5/3007* (2013.01); *F01D 5/3092* (2013.01); *F04D 29/322* (2013.01); *F05C 2201/0466* (2013.01)

(58) Field of Classification Search
CPC ..... F01D 5/3007; F01D 5/3092; F01D 5/06; F01D 5/066; F04D 29/322; F04D 29/34; F04D 29/325; F04D 29/321; F04D 29/185; F04D 5/30; F05C 2201/0466
USPC ..... 416/219 R, 198 A, 201 R, 244 A
See application file for complete search history.

(56) References Cited

U.S. PATENT DOCUMENTS 2,303,148 A * 11/1942 Tinnerman ..... F16B 37/043 411/111
2,495,037 A * 1/1950 Tinnerman ..... F16B 37/044 29/509
2,727,552 A * 12/1955 Chvesta ..... F16B 37/044 411/112
3,238,495 A * 3/1966 Lanius, Jr. ..... H01R 4/40 403/390

(Continued)

FOREIGN PATENT DOCUMENTS

EP 1 873 401 1/2008
EP 1 970 538 9/2008

(Continued)

OTHER PUBLICATIONS

International Search Report Issued Mar. 30, 2011 in PCT/FR11/50116 Filed Jan. 21, 2011.

*Primary Examiner* — Igor Kershteyn
*Assistant Examiner* — Aaron R Eastman
(74) *Attorney, Agent, or Firm* — Oblon, McClelland, Maier & Neustadt, L.L.P.

(57) ABSTRACT

A turbine engine air blower including a rotor disk that includes, on an outer periphery thereof, longitudinal ribs, each including a radial lug for attaching the disk onto a downstream compressor rotor. The flanks of the lugs form abutments for holding vanes that are mounted onto the disk. A mechanism protecting flanks of the lugs is circumferentially inserted between the lugs and the vanes.

5 Claims, 2 Drawing Sheets

(56) References Cited

U.S. PATENT DOCUMENTS

| | | | | |
|---|---|---|---|---|
| 4,887,949 | A * | 12/1989 | Dimmick, III | F01D 5/066 403/22 |
| 5,388,963 | A * | 2/1995 | Dimmick, III | F01D 5/066 403/337 |
| 2007/0048141 | A1* | 3/2007 | Boston et al. | 416/219 R |
| 2008/0003108 | A1* | 1/2008 | Forgue et al. | 416/219 R |
| 2008/0226457 | A1 | 9/2008 | Belmonte | |
| 2009/0136349 | A1* | 5/2009 | Dezouche | 416/219 R |
| 2010/0226777 | A1* | 9/2010 | Forgue et al. | 416/221 |
| 2011/0033283 | A1 | 2/2011 | Chrzastek et al. | |

FOREIGN PATENT DOCUMENTS

| | | | |
|---|---|---|---|
| FR | 2 929 660 | | 10/2009 |
| JP | 07-247804 | A | 9/1995 |
| JP | 2001-132407 | A | 5/2001 |
| JP | 2003-148102 | A | 5/2003 |
| JP | 2008-232146 | A | 10/2008 |
| WO | 2010/066833 | A | 6/2010 |

* cited by examiner

TURBINE ENGINE FAN

BACKGROUND OF THE INVENTION

1. Field of the Invention

The present invention concerns a fan of a turbine engine, such as an aircraft jet engine or turboprop engine.

2. Description of the Related Art

In a known fashion, a turbine engine fan comprises a rotor disc having at its external periphery a plurality of longitudinal ribs delimiting between them slots for the axial mounting and radial retention of blade roots. The downstream end of each rib comprises a radial lug comprising an orifice for a screw or bolt to pass for fixing the fan disc onto an upstream flange of a low-pressure compressor arranged downstream of the fan. The low-pressure compressor is thus driven in rotation with the rotor of the fan by a turbine shaft.

The flanks of each lug form stops for retaining the blades and thus limit their angular movement. In the event of loss of a blade, the blade disconnected from the disc impacts an adjacent blade, which tilts angularly and comes into abutment on the flank of a lug, which transfers the energy released by the impact of the disconnected blade on the adjacent blade to the whole of the disc and thus prevents losses of blades in a cascade.

When the aircraft is on the ground and the turbine engine is stopped, the rotating parts of the turbine engine may undergo autorotation (referred to as "windmilling"). This is because the air entering the turbine engine causes a rotation of the rotor of the fan at a speed of around 40 to 50 revolutions per minute. This low rotation speed does not allow sufficiently great centrifugation of the blades for locking thereof in position in the slots. As a result the blades of the fan may tilt on the flanks of the lugs of the disc ribs. These repeated contacts cause rubbing between the flanks of the lugs and the blades, leading to premature wear on the stops, which requires more frequent repairs to the stops.

At the present time, repair to the flanks of the lugs is carried out by plasma deposition of a metal layer. However, the lugs of the disc thus repaired have a lower fatigue strength than that of the lugs of a new disc. In addition, these depositions of material have limited impact resistance and may progressively disintegrate over time.

Finally, this operation cannot be performed under the wing and requires dismantling and repair in a maintenance workshop, which leads to lengthy and expensive immobilisation times and requires the use of expensive and complex tooling.

BRIEF SUMMARY OF THE INVENTION

The aim of the invention is in particular to afford a simple, economical and effective solution to these various problems.

To this end, it proposes a turbine engine fan comprising a rotor disc having on its external periphery slots for mounting blade roots delimited by longitudinal ribs each having a radial lug for fixing the disc on a downstream compressor rotor, the flanks of the lugs forming stops for retaining the blades mounted on the disc, characterised in that U-shaped clips are mounted on the lugs of the disc and each comprise two lateral tabs covering the flanks of a radial lug.

The invention thus proposes the integration of clips protecting the lugs of the disc, preventing wear on the flanks of the lugs by repeated contact of the blades when the fan is set in autorotation.

It is thus no longer necessary to dismantle the turbine engine to repair the lugs of the fan disc ribs. Integration of these clips is simple to achieve and can be effected on a turbine engine mounted under the wing of an aircraft, avoiding dismantling and transport to a maintenance workshop.

The clips may be engaged axially from the upstream side on the lugs.

In one embodiment of the invention, each clip comprises a transverse wall applied to a radial upstream face of a lug and comprising an orifice aligned with a corresponding orifice in the lug for a screw or bolt to pass for fixing on the downstream compressor rotor.

Thus each clip is clamped on a radial lug of a disc at the fixing with the downstream compressor rotor. The thickness of the transverse wall is sufficiently small not to require the replacement of the fixing screw or bolt with larger screws or bolts.

Advantageously, each lateral tab of a clip comprises a longitudinal U-shaped fold fitting on a stop of a flank of the radial lug, which ensures the axial mounting of the clip on a lug and the radial holding of this clip on this lug.

According to another feature of the invention, each transverse wall of the clip comprises at least one radial tab, the free end of which extends upstream along a rib of the disc.

Preferentially, each clip comprises two aforementioned radial tabs that are parallel and spaced apart circumferentially from each other, which prevents rotation of the clip when it is clamped on the lug.

The invention also concerns a clip for protecting the flanks of a radial lug of a peripheral rib of a fan disc as described previously, characterised in that it comprises two substantially parallel lateral tabs connected by a transverse wall comprising a central orifice, the transverse wall of each clip being extended by two angled tabs the free ends of which extend in a direction opposite to the lateral tabs of the clip.

BRIEF DESCRIPTION OF THE SEVERAL VIEWS OF THE DRAWINGS

The invention will be better understood and other details, advantages and features of the invention will emerge from a reading of the following description given by way of non-limitative example, with reference to the accompanying drawings, in which.

DETAILED DESCRIPTION OF THE INVENTION

Figure 1:
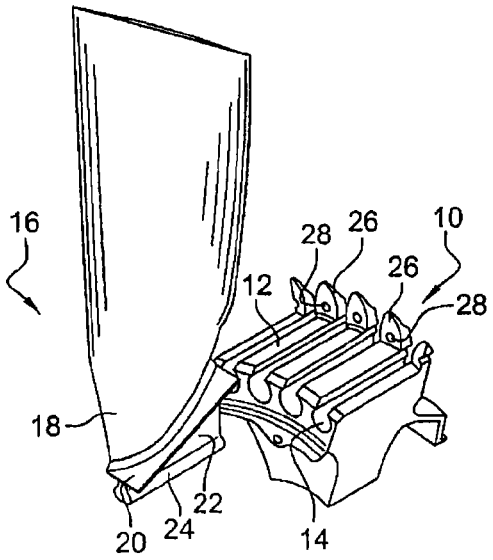
Fig. 1 Background Art
FIG. 1 is a partial schematic view in perspective of a fan disc according to the prior art.

Reference is made first of all to FIG. 1, which shows schematically part of a turbine engine fan disc 10 comprising, at its external periphery, longitudinal ribs 12 delimiting between them slots 14 for the axial mounting and radial holding of blades 16. Each blade 16 comprises a vane 18, a platform 20 formed at the base of the vane and delimiting internally the annular stream for the air flow entering the turbine engine. A zone 22 known as the "prop" connects the platform 20 and the vane 18 to a blade root 24.

Each rib 12 of the fan disc 10 comprises a radial lug 26 formed at its downstream end. These lugs 26 each comprise an axial orifice 28 intended to be aligned with a corresponding orifice formed in an annular flange of a low-pressure compressor rotor arranged downstream (see FIG. 5). Fixing screws are inserted in the orifices 28 in the lugs 26 of the disc 10 and in the orifices in the annular flange of the compressor rotor.

Figure 2:
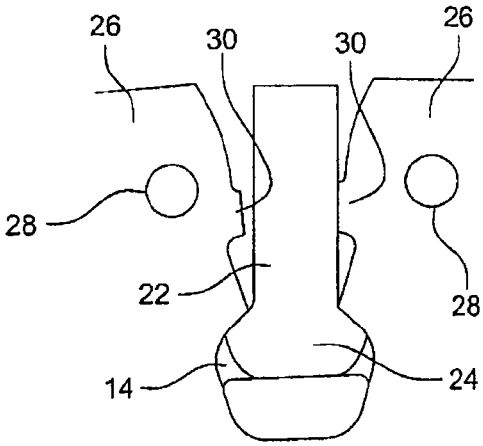
Fig. 2 Background Art
FIG. 2 is a partial schematic view in transverse section of a blade mounted in a slot of a fan disc according to the prior art.

Each radial lug 26 comprises lateral flanks each having a projecting longitudinal stop 30. Each stop 30 formed on the flank of a lug 26 is aligned circumferentially with a stop 30 of an adjacent lug (FIG. 2).

When the blades 16 are mounted on the fan disc 10, it is the props 22 that are situated opposite the longitudinal stops 30.

In the event of the loss of a blade, the disconnected blade impacts an adjacent blade 16, which tilts, and the prop 22 of which comes into contact with a stop 30 of a radial lug 26. These stops 30 thus limit the angular movement of the blade 16 experiencing the pressure of the disconnected blade and allows a transfer of energy from the impact to the fan disc 10.

It was found in the prior art that these stops 30 were subjected to relatively high wear due essentially to the impacts of the starting and stopping of the turbine engine and its occasional functioning in autorotation when at rest on the ground. This is because the air entering the turbine engine causes rotation of the fan that is not sufficiently high to achieve a centrifugation of the blade 16 and locking of the blade roots 24 in a stable position in the slots 14. The result is successive tiltings of the blades 16 leading to rubbing between the props 22 and the stops 30, resulting in wear on the stops 30 of the radial lugs 26.

The solutions proposed in the prior art and disclosed previously are not lasting and require dismantling of the turbine engine in order to effect repair in a maintenance workshop and expensive equipment.

Figure 3:
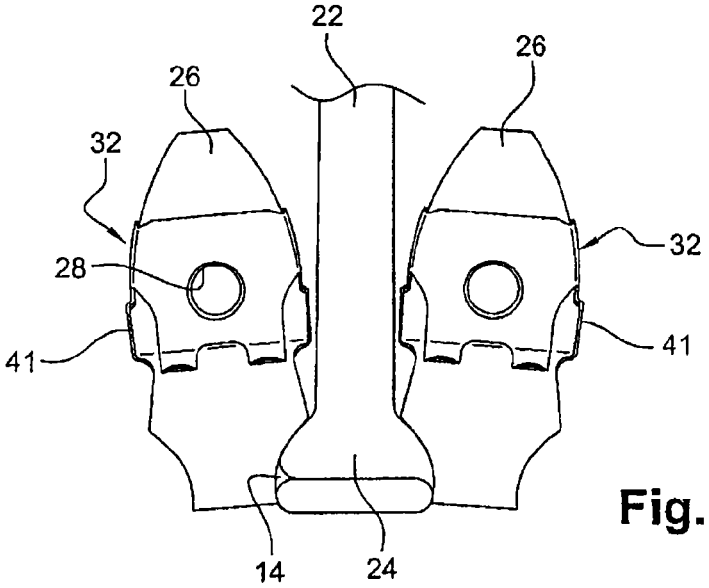
FIG. 3 is a schematic view from upstream of part of a disc comprising means of protecting the lugs of the disc according to the invention.

According to the invention, clips 32 are mounted on the radial lugs 26 of the fan disc 10 and cover the flanks of the lugs 26 for protection of the stops 30 (FIG. 3).

Figure 4A:
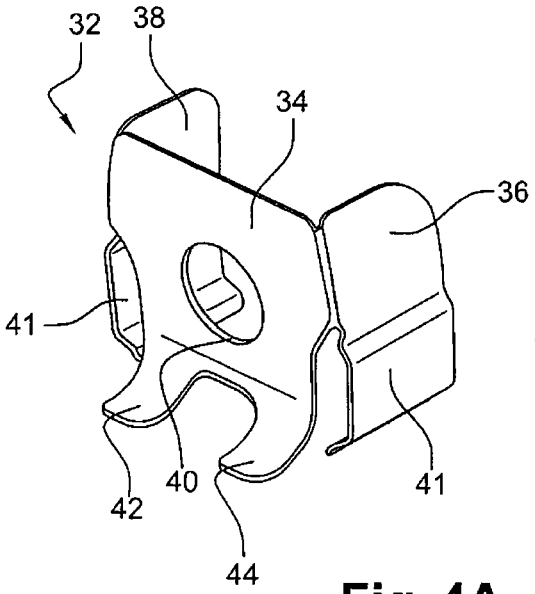
FIGS. 4A and 4B are perspective views of clips for protecting the radial lugs of a disc of a fan according to the invention.
Figure 4B:
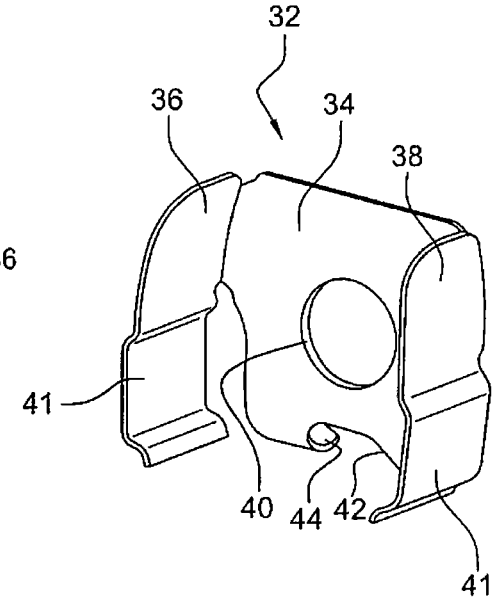

Each clip has a U shape and comprises a transverse wall 34 of substantially rectangular shape connected to two parallel lateral tabs 36, 38. The transverse wall 34 comprises a central orifice 40 and is extended by two radial flat tabs 42, 44 that are parallel and the ends of which are curved in a direction opposite to the lateral tabs 36, 38, these two radial tabs 42, 44 being spaced apart from each other (FIGS. 4A and 4B).

The lateral tabs 36, 38 of a clip 32 each comprise a longitudinal fold 41 in a U, intended to fit on a longitudinal stop 30 of a lug 26 of the disc 10.

Figure 5:
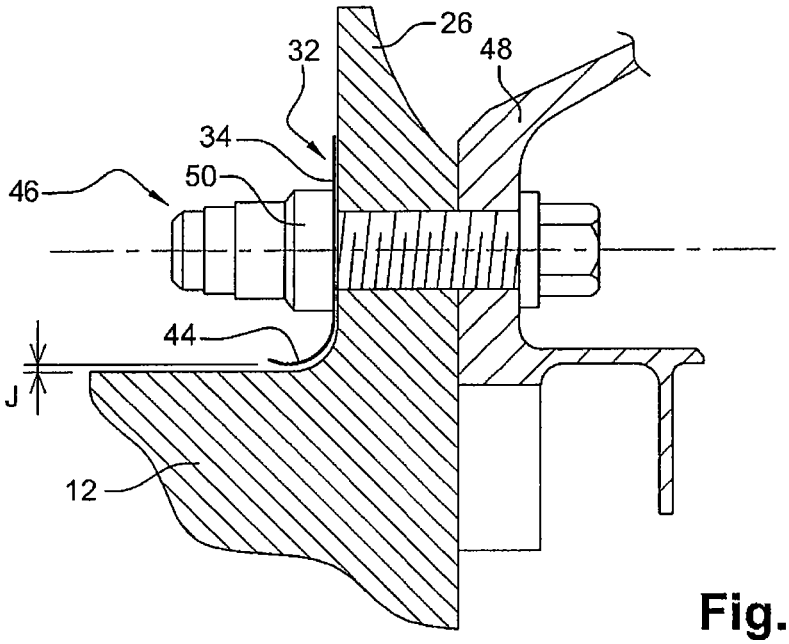
FIG. 5 is a schematic view in axial section of the fixing of the fan disc according to the invention to a low-pressure compressor rotor arranged downstream.

For mounting a clip 32 on a lug 26 of the turbine engine disc 10, the clip 32 is positioned on the disc 10 so that the radial lugs 42, 44 extend along a rib 12 and towards the upstream side of the disc 10. The clip 32 is then translated downstream so that the U-shaped 41 folds of the lateral tabs 36, 38 fit on the longitudinal stops 30 of the radial lug 26 of the disc 10, the transverse wall 34 of the clip 32 coming to be applied against the upstream radial face of the radial lug 26. A fixing screw 46 is then inserted from the downstream side in the aligned orifices of the clip 32, the lug 26 and the annular flange 48 of the low-pressure compressor rotor. A fixing nut 50 is tightened on the upstream face of the clip 32 (FIG. 5).

Insertion of the clip 32 causes no change in the dimensions of the fixing screws 46 given the very small thickness of the transverse wall 34, which is around a few tenths of a millimeter.

It is desirable to size a clip 32 so that the radial tabs 42, 44 are mounted with a radial clearance J with respect to a rib 12 on the disc 10 in order to compensate for the tolerances in the radial positioning of an orifice 28 on a radial lug 26 and thus guarantee in all circumstances an alignment of the orifice 40 in a clip 32 with an orifice 28 in a radial lug 26.

This type of protective clip 32 for the flanks of the lugs can be used both on a new fan disc 10 and on a disc in the course of use. In the latter case, if the stop 30 exhibit any wear, it is necessary to carry out bleaching by grinding the surface of the stops 30 so as to have a smooth surface in contact with the clip 32. This operation therefore consists of removing between 0.2 and 0.5 millimeters of material at the flanks of a worn lug.

The clips 32 can be integrated on the lugs 26 of a fan disc 10 when the turbine engine is in place under the wing of the aircraft, which reduces the immobilisation times and does not require complicated equipment since each clip 32 is secured by means of a pre-existing fixing element.

The clips 32 can be produced from a metal material such as INCONEL and the blades 16 can be made from titanium. In this way the clips 32 wear less quickly than the blades 16.

The clips 32 can be produced by successive operations of folding and cropping a metal sheet or by machining a block of material.

The invention claimed is:

1. A turbine engine fan comprising:

a rotor disc including on its external periphery slots for mounting blade roots delimited by longitudinal ribs each including a radial lug for fixing the disc on a compressor rotor downstream, flanks of the lugs forming stops for holding the blades mounted on the disc; and U-shaped clips mounted on the lugs, each U-shaped clip comprises two lateral tabs covering the flanks of the lugs, wherein each U-shaped clip comprises a transverse wall applied to a radial upstream face of a lug and comprising an orifice aligned with a corresponding orifice in the lug for passage of a screw or bolt for fixing on the compressor rotor downstream, and wherein the transverse wall of each U-shaped clip comprises at least one radial tab, an end of which extends towards an upstream side along a rib of the disc.

2. A fan according to claim 1, wherein the U-shaped clips are engaged axially from an upstream side on the lugs.

3. A fan according to claim 1, wherein each lateral tab comprises a longitudinal fold fitting on a stop of a flank of the lug.

4. A fan according to claim 3, wherein each U-shaped clip comprises two radial tabs parallel and spaced apart circumferentially from each other.

5. A clip to protect flanks of a radial lug of a peripheral rib of a fan disc according to claim 4, comprising:

two substantially parallel lateral tabs connected by a transverse wall, wherein the transverse wall comprises a central orifice, and wherein the transverse wall is extended by two angled tabs, free ends of which extend in a direction opposite to the lateral tabs of the clip.

* * * * *